US007419419B2

(12) United States Patent
Moon

(10) Patent No.: US 7,419,419 B2
(45) Date of Patent: Sep. 2, 2008

(54) SLURRY SUPPLY UNIT FOR CMP APPARATUS

(75) Inventor: Sang Tae Moon, Busan (KR)

(73) Assignee: Dongbu Electronics Co., Ltd., Seoul (KR)

( * ) Notice: Subject to any disclaimer, the term of this patent is extended or adjusted under 35 U.S.C. 154(b) by 72 days.

(21) Appl. No.: 11/590,369

(22) Filed: Oct. 30, 2006

(65) Prior Publication Data

US 2007/0111639 A1 May 17, 2007

(30) Foreign Application Priority Data

Oct. 28, 2005 (KR) ..... 10-2005-00102304

(51) Int. Cl.
*B24B 57/00* (2006.01)

(52) U.S. Cl. ..... 451/5; 451/60; 451/446

(58) Field of Classification Search ..... 451/41, 451/5, 8, 60, 446
See application file for complete search history.

(56) References Cited

U.S. PATENT DOCUMENTS 4,513,894 A * 4/1985 Doyle et al. ..... 222/644
5,490,809 A * 2/1996 Jones et al. ..... 451/60
5,857,893 A * 1/1999 Olsen et al. ..... 451/5
5,945,346 A * 8/1999 Vanell et al. ..... 438/691
5,993,299 A * 11/1999 Chen et al. ..... 451/60

* cited by examiner

*Primary Examiner*—Robert Rose
(74) *Attorney, Agent, or Firm*—Andrew D. Fortney

(57) ABSTRACT

A slurry supply unit for a CMP apparatus is disclosed. The slurry supply unit includes a slurry flow sensor in a slurry injection pipe to measure the flow of the injected slurry, an auxiliary pump engaged with a slurry distribution line to discharge the slurry at a predetermined flow, and a slurry flow control section regulating the flow of the discharged slurry by controlling the auxiliary pump if the flow of the slurry as measured by the slurry flow sensor deviates from a preset reference. Here, the slurry supply unit may be used in a CMP apparatus including a slurry supply tank; a slurry circulation line connected to the slurry supply tank; a main pump circulating the slurry in the slurry circulation line; a CMP unit; and a slurry distribution line from the slurry circulation line to the slurry injection pipe of the CMP unit. If a planarization process of a semiconductor wafer is performed using the slurry supply unit, the amount of the slurry supplied to the apparatus can be controlled more precisely.

16 Claims, 4 Drawing Sheets

SLURRY SUPPLY UNIT FOR CMP APPARATUS

BACKGROUND OF THE INVENTION

1. Field of the Invention

The present invention relates to production equipment used in manufacturing a semiconductor device, and more particularly to a slurry supply unit for a CMP (Chemical Mechanical Polishing) apparatus for uniformly supplying the slurry containing a polishing agent to the CMP apparatus.

2. Description of the Related Art

As semiconductor devices are highly integrated, the wire structures tend to have multi-layers and level differences between stacked unit cells increase. The level differences can generate inferiority of the devices, and various methods have been suggested to reduce the level differences.

A CMP apparatus is production equipment used in a planarization process of a semiconductor device that chemically and physically polishes a surface of a semiconductor wafer using slurry including a mixture of a polishing agent and DI-water and a polishing pad rotating together with the slurry.

On the other hand, in the planarization process using the CMP apparatus, a plurality of CMP units are generally connected to one slurry supply unit to reduce the manufacturing cost.

FIG. 1 shows a preferred embodiment of CMP equipment including a conventional slurry supply unit.

As shown in FIG. 1, the conventional CMP equipment connects a plurality of CMP units 30*a* to 30*n* to one slurry supply tank 10. A slurry circulation line 20 is connected to a slurry supply tank 10 and slurry is supplied to the CMP units 30*a* to 30*n* through the slurry circulation line 20.

The slurry is circulated, for example, in direction A in the slurry circulation line 20 through a main pump 12 installed in the slurry supply tank 10 and is supplied to the CMP units 30*a* to 30*n* through the slurry distribution lines 22*a* to 22*n* that branch out from the slurry circulation line 20. The slurry distribution lines 22*a* to 22*n* are connected to the CMP units in a one to one relationship. The slurry supplied to the CMP unit through the slurry distribution lines 22*a* to 22*n* is injected onto a rotational table of a CMP unit through the corresponding slurry injection pipe 32.

Further, in the CMP units 30*a* to 30*n*, a wafer 38 is fixed to a carrier 36 and is generally located on the rotational table 34 to which a polishing pad of a resilient material is attached. Then, a uniform downward force is applied through the carrier 36 and one surface of the wafer 38 makes contact with the polishing pad. Thus, if the rotational table 34 is rotated at a predetermined speed, the wafer 38 is rotated at a predetermined speed together with the carrier 36. A predetermined amount of slurry is distributed on the rotational table 34 or the polishing pad through a slurry injection opening 32. Therefore, the polishing operation of the slurry and the rotation of the rotational table 34 and the wafer 38 are combined with each other to polish a surface of the wafer 38.

The above-mentioned central supply method supplying slurry to a plurality of CMP units with one slurry supply unit is advantageous in the aspect of cost reduction. However, in the central supply method, the flow amount or rate of the slurry branched to the CMP units may become different according to the operation degree of the CMP units. Namely, the flow amount of the slurry can be different in each CMP unit 30*a*-30*n*. In this case, since the amount of the slurry reacting with a surface of a wafer may differ from unit to unit, the polishing amount may become non-uniform, thereby exerting undesired variations in the polished devices and an adverse influence on the CMP characteristics.

SUMMARY OF THE INVENTION

A slurry supply unit for a CMP apparatus used in manufacturing a semiconductor device is disclosed.

The slurry supply unit for a CMP apparatus according to the present invention comprises: a first slurry flow sensor installed in the slurry injection pipe of the CMP unit to measure the flow rate of the injected slurry, an auxiliary pump engaged with a slurry distribution line to discharge the slurry from a slurry circulation line at a predetermined flow rate, and a slurry flow rate control section regulating the flow rate of the discharged slurry by controlling the auxiliary pump if the flow rate of the slurry measured by the first slurry flow rate sensor deviates more than a predetermined amount from a preset reference. Here, the slurry supply unit may be useful in a CMP apparatus that comprises a slurry supply tank; a slurry circulation line connected to the slurry supply tank; a main pump circulating the slurry stored in the slurry supply tank in the slurry circulation line; a plurality of CMP units in which slurry injection pipes are installed; and a plurality of slurry distribution lines from the slurry circulation line to supply the slurry to the slurry injection pipes.

The slurry supply unit can further comprise a second slurry flow sensor measuring the flow rate of the slurry supplied form the slurry circulation line to the auxiliary pump. The first slurry flow sensor and the second slurry flow sensor can each include a liquid flow rate measuring unit. The slurry flow rate control section comprises a display section displaying the flow rate of the slurry measured by the first slurry flow rate sensor and a user input section through which a user can input the preset reference flow rate of the slurry to the control section.

On the other hand, the slurry supply unit may comprise: a CMP unit in which a slurry injection pipe is installed; a slurry supply tank; and a pump connected to the slurry supply tank to supply the slurry stored in the slurry supply tank to the slurry injection pipe of the CMP unit through a slurry supply line. Here, a slurry flow sensor is installed in the slurry injection pipe to measure the flow rate of the injected slurry. Further, the slurry supply unit comprises a slurry flow rate control section regulating the flow rate of the discharged slurry by controlling the pump if the flow rate of the slurry measured by the slurry flow sensor deviates from a preset reference.

According to the slurry supply unit for the CMP apparatus of the present invention, since a uniform amount of slurry can be supplied to the CMP units in a CMP process, the polishing uniformity according to the flow rate of the slurry can be solved or improved. Therefore, the CMP characteristics of a wafer can be uniformly maintained.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Hereinafter, preferred embodiments of the present invention will be described with reference to the accompanying drawings.

Figure 1:
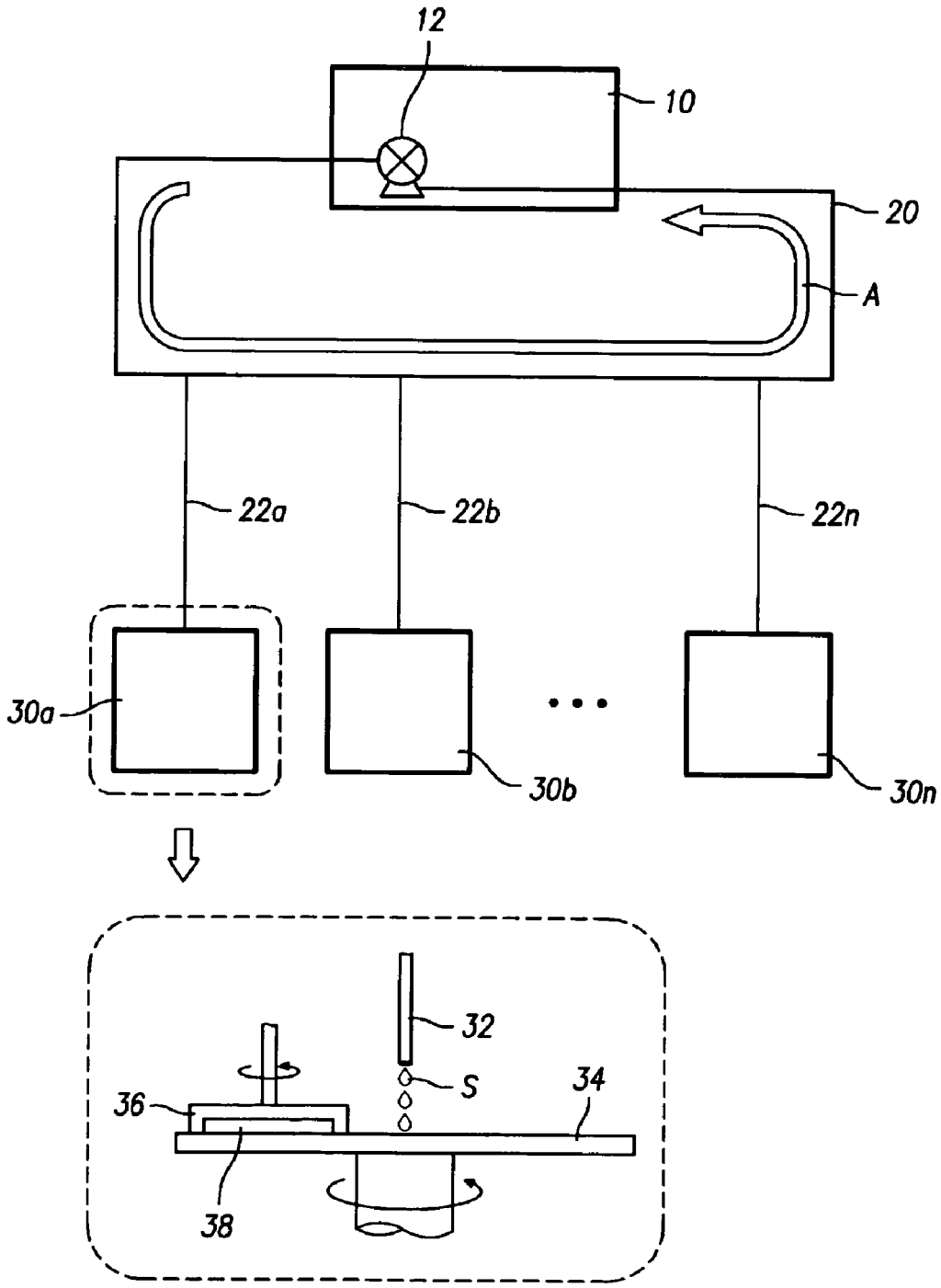
FIG. 1 (Related Art)
FIG. 1 is a view schematically showing a slurry supply unit for a conventional CMP apparatus using a central supply method.
Figure 2:
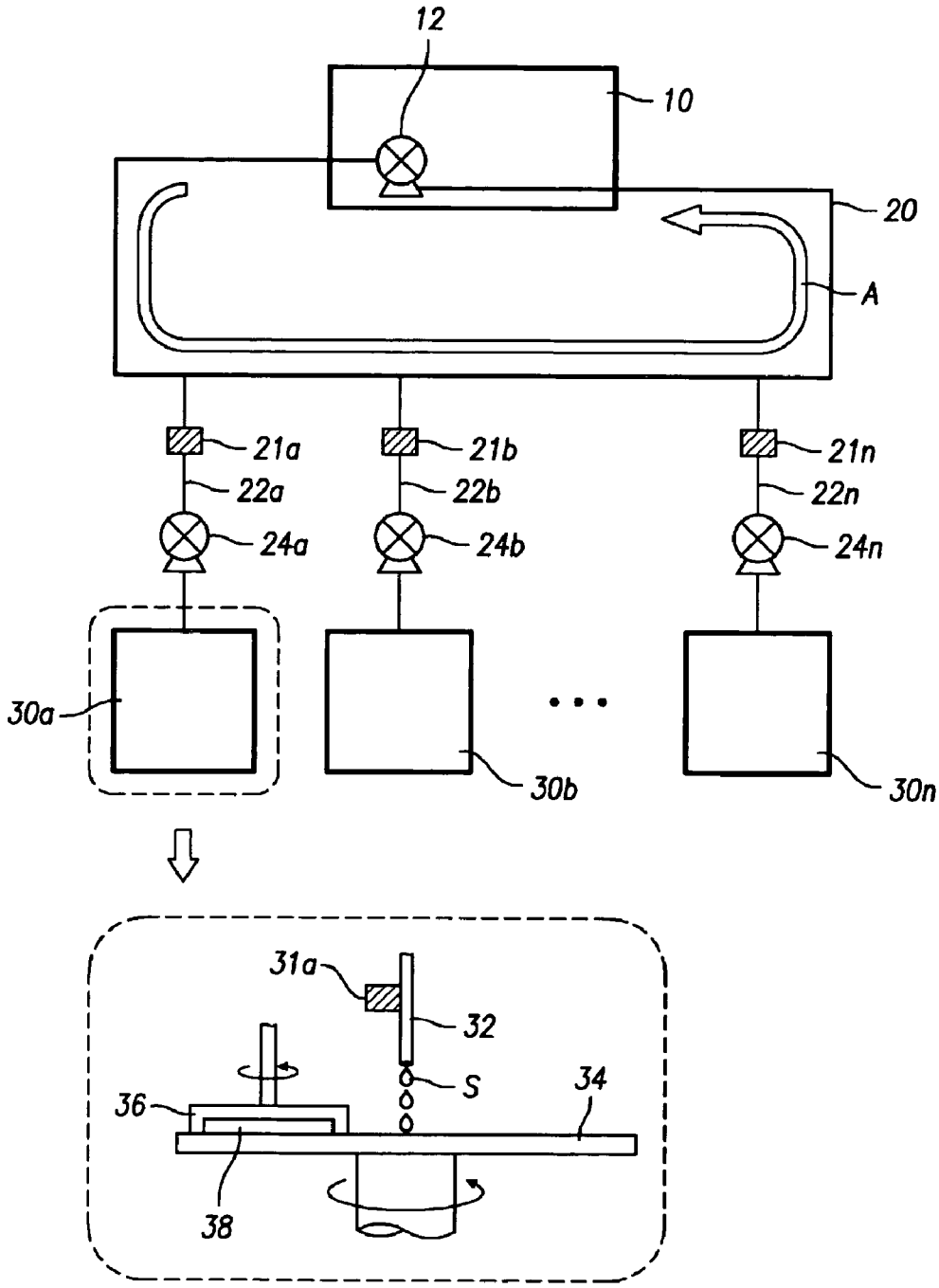
FIG. 2 is a view schematically showing a slurry supply unit for a CMP apparatus according to the present invention.

FIG. 2 shows an example of a slurry supply unit for a CMP apparatus according to the present invention.

Figure 3:
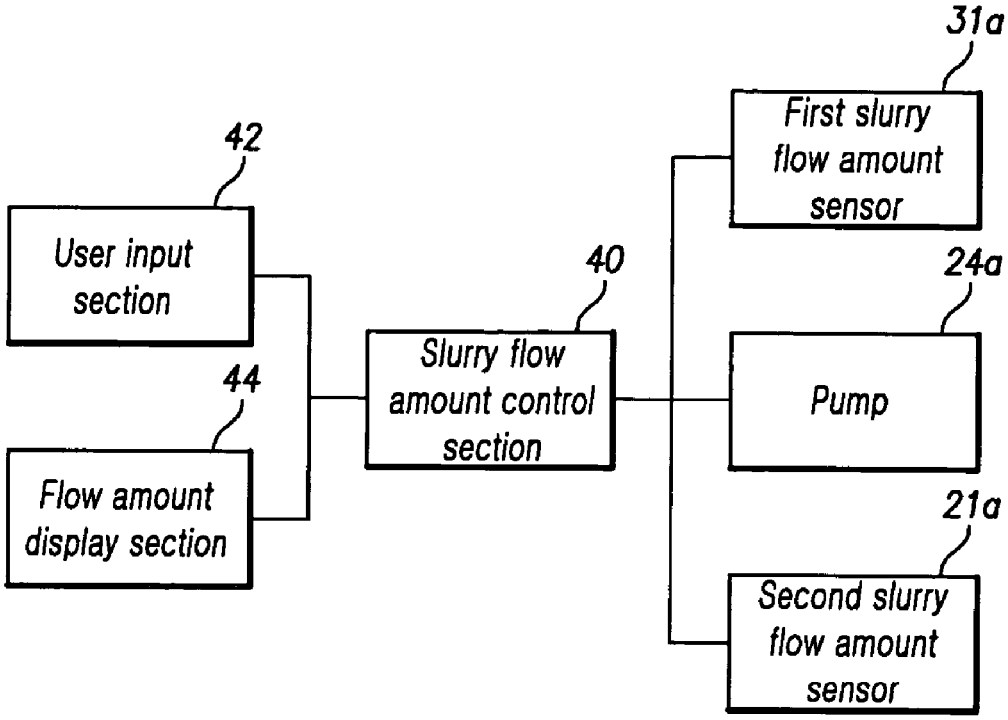
FIG. 3 is a block diagram schematically showing a slurry flow rate control system employing a slurry supply unit according to the present invention.

FIG. 3 is a block diagram for showing a slurry flow rate control system employed by the slurry supply unit shown in FIG. 2.

As shown in FIGS. 2 and 3, the slurry supply unit for the CMP apparatus includes a slurry supply tank 10, a slurry circulation line 20 and a main pump 12 connected to the slurry supply tank 10, a plurality of CMP units 30*a* to 30*n* each containing a slurry injection pipe 32, and a corresponding plurality of slurry distribution lines 22*a* to 22*n* that branch out from and that are in fluid communication with the slurry circulation line 20 to supply slurry to the slurry injection pipes 32.

The slurry supply unit further includes a first slurry flow sensor, an auxiliary pump, and a slurry flow rate control section. The first slurry flow sensor 31*a* is mounted to the slurry injection pipe 32 installed in the CMP unit 30*a*. The first slurry flow sensor 31*a* measures the flow rate of the slurry injected through the slurry injection pipe 32 and transmits the measured data to a slurry flow rate control section 40. Here, the first slurry flow sensor 31*a* can include a liquid flow rate measuring unit. Further, an auxiliary pump 24*a* is installed in the slurry distribution line 22*a* and supplies the slurry supplied from the slurry circulation line 20 at a set flow rate to the CMP unit 30*a*. The slurry flow rate control section 40 regulates the flow rate of the discharged slurry by controlling the auxiliary pump 24*a* in the case in which the flow rate of the slurry which is measured in the first slurry flow sensor 31*a* deviates by more than a predetermined amount from a preset reference.

The slurry supply unit can precisely control the amount of the slurry supplied to the CMP units 30*a* to 30*n* through the additionally mounted auxiliary pump 24*a* to 24*n* (e.g., from wafer-to-wafer and from lot-to-lot).

The amount of the slurry supplied to a rotational table 34 can be monitored through the first slurry flow rate sensor 31*a* installed in the CMP units 30*a* to 30*n*. If the amount of the slurry which is measured through the first slurry flow sensor 31*a* deviates from a reference value, the slurry flow rate control section 40 corrects the discharge rate of the auxiliary pump 24*a*, preferably so that the discharge rate of the auxiliary pump 24*a* matches the discharge rate of the auxiliary pumps 24*b*-24*n* (e.g., such that the discharge rate of each of the auxiliary pumps 24*a*-24*n* is within a predetermined range of values). The polishing process may be stopped by separating the CMP unit from a wafer if the correction fails. In one embodiment, the preset reference is from 100 to 800 ml/min (e.g., from 150 or 200 ml/min to 500 or 600 ml/min), and the discharge rate of the pump does not deviate by more than 15%, 20% or 25% from the preset reference. In another embodiment, the discharge rate of the pump does not deviate by more than 50, 100 or 150 ml/minute from the preset reference. Of course, the main pump 12 and the auxiliary pumps 24*a*-24*n* can have different discharge rates and allowable deviations. In general, the main pump 12 will have a lower discharge rate and allowable deviation than the auxiliary pumps 24*a*-24*n*.

Second slurry flow sensors 21*a* to 21*n* can be installed in the slurry distribution lines 22*a* to 22*n*. The second slurry flow sensor 21*a* to 21*n* are installed in the slurry distribution lines 22*a* to 22*n* and are installed at front ends of the auxiliary pumps 24*a* to 24*n* to measure the flow rate of the slurry supplied to the auxiliary pumps 24*a* to 24*n* from the slurry circulation line 20.

The amount or rate of the slurry supplied to the CMP units through the second slurry flow sensor can be measured before the CMP process is performed, and the supply rate of the slurry can be set independently. The second slurry flow sensor can include a liquid flow rate measuring unit similar to the first slurry flow sensor and can be controlled by the slurry flow rate control section.

On the other hand, it is preferable that the first slurry flow sensor, the second slurry flow sensor, and the auxiliary pump are individually installed in each CMP unit and each slurry distribution line, but the slurry flow rate control section can be installed so as to control the pumps in all the CMP units and on the main pump 12 through one main computer. Alternatively, individual rate controllers can be individually installed in each CMP unit and on the main pump 12 to be controlled independently.

The slurry flow rate control section can further includes a display section 44 displaying the flow rates of the slurry measured by the first slurry flow sensor and the second slurry flow sensors, and an user input section 42 configured to input information, in which a user can input to the control section the preset reference values of the flow rates of the slurry to be supplied to the CMP unit(s) and (optionally) to the main pump 12. The user input section 42 may also allow input of the acceptable limits of variation or deviation from the preset reference values.

Figure 4:
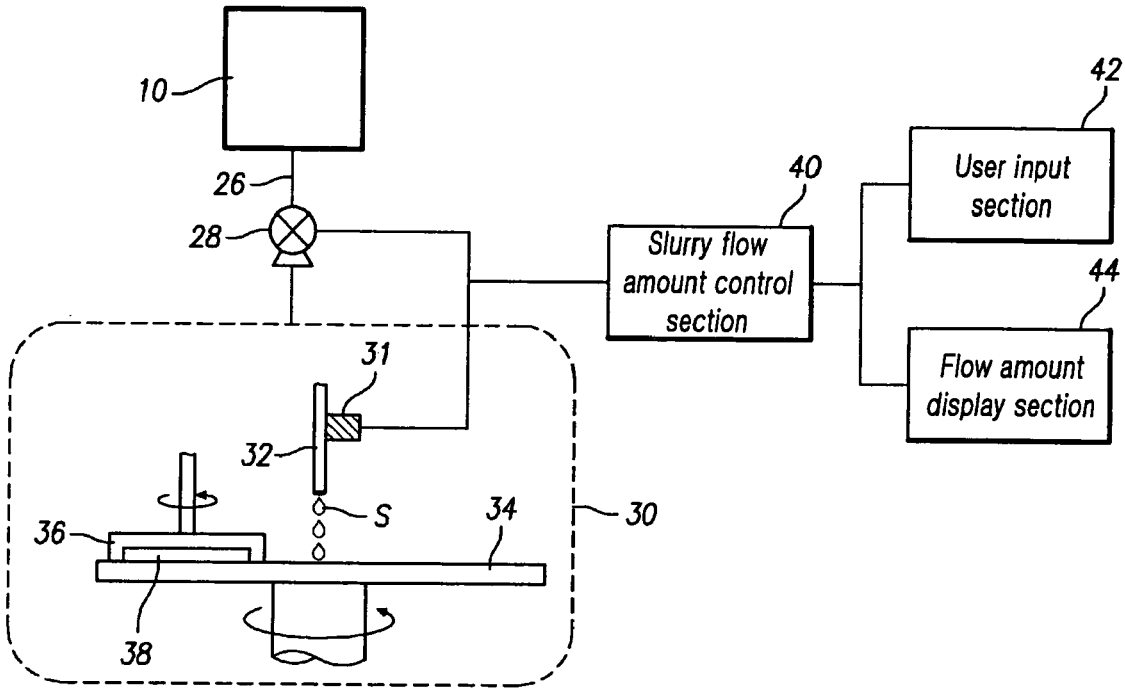
FIG. 4 is a view schematically showing a slurry supply unit for a CMP apparatus using a local supply method.

Next, another preferred embodiment of a slurry supply unit according to the present invention with reference to FIG. 4.

FIG. 4 shows the preferred embodiment of the present invention and shows an example of installing the slurry supply unit using a local supply method.

As shown in FIG. 4, the slurry supply unit includes a CMP unit in which a slurry injection pipe 32 is installed, a slurry supply tank 10 in which the slurry is stored, and a pump 28 connected to the slurry supply tank 10 to supply the stored slurry to the slurry injection pipe 32 of the CMP unit 30 through a slurry supply line 26.

The slurry supply unit includes a slurry flow sensor 31 installed in the slurry injection pipe 32 of the CMP unit 30 to measure the flow rate of the injected slurry and a slurry flow rate control section 40 for regulating the flow rate of the discharged slurry by controlling the pump 28 in the case in which the flow rate of the slurry which is measured by the slurry flow sensor 31 deviates from a preset reference. Here, the slurry flow sensor 31 can include a liquid flow rate measuring unit.

The slurry supply unit shown in FIG. 4 is implemented and/or used in a local supply method a little differently from the above-mentioned slurry supply unit. Generally, in CMP equipment according the local supply method, one CMP unit is connected to one slurry supply tank to be used with that CMP unit, and the flow rate of the slurry in such a supply unit has conventionally been manually regulated. In the case of the local supply method, since the movement distance from the slurry supply tank to the CMP unit is short, the flow rate of the slurry can be regulated using a pump. Therefore, as compared to the central supply method, the problem of lowering the CMP characteristics due to the change of the flow rate of the slurry is not as severe. However, the flow rate of the slurry still should be controlled. Therefore, since the present slurry supply unit can precisely control the flow rate of the slurry in a local supply method, the polishing rate of the wafers can be precisely controlled from wafer-to-wafer and from lot-to-lot, as compared with the manual control.

On the other hand, as mentioned in the above example, in the slurry flow rate control section 40, a display section 44 displaying the flow rate of the slurry which is measured by the slurry flow rate sensor 31 and a user input section 42 for inputting to the control section the preset reference of the flow rate of the slurry to be supplied to the CMP unit (as well as the allowable limit[s] of variation or deviation therefrom) can be installed.

In the slurry supply unit for the CMP apparatus according to the present invention, since a predetermined rate of slurry can be supplied to the CMP unit in the CMP process and limits to a deviation from the predetermined rate can be controlled, the problem of non-uniform polishing according to the change of the flow rate of the slurry can be solved. Therefore, the CMP characteristics of a wafer can be constantly maintained.

Further, according to the slurry supply unit according to the present invention, the deviation between the flow rate of the slurry circulating through the slurry circulation line and the flow rate of the slurry supplied to the CMP apparatus while the CMP process is proceeding can be recognized and automatically corrected. Furthermore, if the correction is not or cannot be performed, the polishing process can be immediately stopped in the problematic CMP apparatus. Therefore, the CMP apparatus in which regulation of the flow rate fails can be easily recognized, and necessary or desired action can be taken in the CMP apparatus.

Hereinafter, an example of regulation of the flow rate using the slurry flow sensor in the preferred embodiments of the slurry supply unit according to the present invention will be described.

In the CMP apparatus, in the case in which the flow rate of the slurry is set to 200 ml/min, the flow rate of the slurry circulating in the slurry circulation line is set to 400 to 600 ml/min (e.g., 500±100 ml/min), and the flow rate of the slurry supplied to the CMP apparatus is set to 300 to 400 ml/min (e.g., 350±50 ml/min), a first setting value of the first slurry flow sensor can be 400 to 600 ml/min (e.g., 500±100 ml/min) and a first setting value of the second slurry flow rate sensor can be 300 to 400 ml/min (e.g., 350±50 ml/min). Therefore, if the value of the first slurry flow sensor deviates from the first setting value (e.g., by more than 100 ml/min from the preset reference value of 500 ml/min), the first setting value can be maintained by regulating the discharge rate of the pump. Further, if the value of the second slurry flow sensor deviates from the second setting value (e.g., by more than 50 ml/min from the preset reference value of 350 ml/min), the second setting value can be maintained by regulating the discharge rate of a precision pump.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A slurry supply unit for a chemical mechanical polishing (CMP) apparatus comprising:

a supply tank for storing a slurry;

a slurry circulation line connected to the supply tank;

a main pump for circulating the slurry through the slurry circulation line;

a plurality of slurry distribution lines connected to the slurry circulation line, a plurality of CMP units each having a slurry injection pipe for injecting the slurry onto a table, wherein each of the plurality of slurry distribution lines delivers the slurry to one of the plurality of CMP units;

a plurality of first slurry flow sensors, each mounted in one of the slurry injection pipes to measure a flow rate of the slurry through the corresponding slurry injection pipe;

a plurality of auxiliary pumps, each engaged with a separate one of the plurality of slurry distribution lines to discharge the slurry from the slurry circulation line at a predetermined flow rate; and a slurry flow rate control section receiving the flow rates from the plurality of first slurry flow sensors and regulating the flow rate of the discharged slurry by controlling the auxiliary pumps.

2. A slurry supply unit according to claim 1, further comprising: a plurality of second slurry flow sensors each installed in one of the plurality of slurry distribution lines upstream of one of the auxiliary pumps, for measuring second flow rates of the slurry supplied from the slurry circulation line to the auxiliary pumps.

3. A slurry supply unit according to claim 1, wherein each of the plurality of first slurry flow sensors comprises a liquid flow rate measuring unit.

4. A slurry supply unit according to claim 2, wherein each of the plurality of first slurry flow sensors and each of the plurality of second slurry flow sensors comprises a liquid flow rate measuring unit.

5. A slurry supply unit according to claim 1, wherein the slurry flow rate control section comprises a display section displaying the flow rate of the slurry as measured by the plurality of first slurry flow sensors and a user input section configured for inputting the predetermined flow rate.

6. A slurry supply unit according to claim 2, wherein the slurry flow rate control section comprises a display section displaying the second flow rates and a user input section configured for inputting the predetermined flow rate.

7. A slurry supply unit according to claim 1, wherein the slurry flow rate control section regulates the flow rates of the slurry to each of the plurality of CMP units at independent predetermined flow rates.

8. A slurry supply unit according to claim 7, wherein each of the plurality of CMP units has an independent slurry flow rate control section.

9. A slurry supply unit according to claim 1, wherein the predetermined flow rate is from about 100 mL/min. to about 800 mL/min.

10. A slurry supply unit according to claim 1, wherein the predetermined flow rate is from about 150 mL/min. to about 600 mL/min.

11. A slurry supply unit according to claim 1, wherein the predetermined flow rate is from about 200 mL/min. to about 500 mL/min.

12. A slurry supply unit according to claim 1, wherein the slurry flow rate control section maintains the flow rate within a predetermined range of deviation from the predetermined flow rate by regulating the auxiliary pump in response to measurements sent from the first slurry flow sensors to the slurry flow rate control section.

13. A slurry supply unit according to claim 12, wherein the predetermined range of variation is plus or minus 15% of the predetermined flow rate.

14. A slurry supply unit according to claim 12, wherein the predetermined range of variation is plus or minus 20% of the predetermined flow rate.

15. A slurry supply unit according to claim 12, wherein the predetermined range of variation is plus or minus 25% of the predetermined flow rate.

16. A slurry supply unit according to claim 12, wherein slurry flow rate control section maintains a flow rate of the circulation line at about 400 to about 600 mL/min. and a flow rate of the slurry injection pipes at about 300 to about 400 mL/min.

* * * * *